US009021947B2

(12) United States Patent
Landa

(10) Patent No.: US 9,021,947 B2
(45) Date of Patent: May 5, 2015

(54) METHOD AND AN APPARATUS FOR PROCESSING A LENTICULAR PRINTING SUBSTRATE

(75) Inventor: Benzion Landa, Nes Ziona (IL)

(73) Assignee: HumanEyes Technologies Ltd., Jerusalem (IL)

( * ) Notice: Subject to any disclaimer, the term of this patent is extended or adjusted under 35 U.S.C. 154(b) by 563 days.

(21) Appl. No.: 12/999,314

(22) PCT Filed: Jun. 16, 2009

(86) PCT No.: PCT/IL2009/000596

§ 371 (c)(1), (2), (4) Date: Dec. 16, 2010

(87) PCT Pub. No.: WO2010/004548

PCT Pub. Date: Jan. 14, 2010

(65) Prior Publication Data

US 2011/0100243 A1 May 5, 2011

Related U.S. Application Data

(60) Provisional application No. 61/129,270, filed on Jun. 16, 2008.

(51) Int. Cl.

| | |
|---|---|
| ***B41M 3/14*** | (2006.01) |
| ***B41F 13/00*** | (2006.01) |
| ***B41F 17/00*** | (2006.01) |
| ***B41M 3/00*** | (2006.01) |

(52) U.S. Cl.

CPC ..... *B41F 17/00* (2013.01); *B41M 3/14* (2013.01); *B41M 3/00* (2013.01)

(58) Field of Classification Search

CPC ..... B41M 3/148; B41M 3/003; B41M 3/14; B41M 3/00; B41F 17/00; G03F 7/70283

USPC ..... 101/147, 148

See application file for complete search history.

(56) References Cited

U.S. PATENT DOCUMENTS 2,317,198 A * 4/1943 Kasper ..... 72/51
2,362,817 A * 11/1944 Haycock ..... 413/1

(Continued)

FOREIGN PATENT DOCUMENTS

EP 0238043 9/1987
EP 1927469 6/2008

(Continued)

OTHER PUBLICATIONS

Communication Pursuant to Article 94(3) EPC Dated Oct. 17, 2011 From the European Patent Office Re. Application No. 09787443.2.

International Preliminary Report on Patentability Dated Dec. 29, 2010 From the International Bureau of WIPO Re. Application No. PCT/IL2009/000596.

(Continued)

*Primary Examiner* — David Banh

(57) ABSTRACT

A method for preparing a lenticular guide roll for use in a lenticular printing run. The method comprises providing a printing roll of a printing press and a first piece of lenticular media. The first piece of lenticular printing substrate has a pitch which is substantially identical to a second lenticular printing substrate to be used in the lenticular printing run. The, method further comprises attaching the first piece of lenticular printing substrate to the printing roll to allow the maneuvering of the second lenticular printing substrate by the printing roll in the printing press.

17 Claims, 8 Drawing Sheets

(56) References Cited

U.S. PATENT DOCUMENTS

| | | | | | |
|---|---|---|---|---|---|
| 2,724,312 | A * | 11/1955 | Gruetzner | 396/330 |
| 3,050,649 | A * | 8/1962 | Thomasko | 310/247 |
| 3,301,992 | A * | 1/1967 | Seeloff | 219/105 |
| 3,462,226 | A | 8/1969 | Iluffaker | |
| 4,925,506 | A * | 5/1990 | Baker | 156/64 |
| 5,890,430 | A | 4/1999 | Wirz | |
| 6,074,192 | A * | 6/2000 | Mikkelsen | 425/327 |
| 6,276,269 | B1 * | 8/2001 | Bravenec | 101/178 |
| 6,467,411 | B1 * | 10/2002 | Naniwa et al. | 101/477 |
| 2004/0109010 | A1 * | 6/2004 | Blish et al. | 345/646 |
| 2007/0131015 | A1 * | 6/2007 | Matsumura et al. | 72/368 |
| 2008/0121008 | A1 * | 5/2008 | Yanokura et al. | 72/199 |

FOREIGN PATENT DOCUMENTS

| | | |
|---|---|---|
| JP | 04-269544 | 9/1992 |
| JP | 09-123395 | 5/1997 |
| JP | 11-198342 | 7/1999 |
| JP | 2008-132721 | 6/2008 |
| WO | WO 99/12718 | 3/1999 |
| WO | WO 2010/004548 | 1/2010 |

OTHER PUBLICATIONS

International Search Report and the Written Opinion Dated Nov. 9, 2009 From the International Searching Authority Re. Application No. PCT/IL2009/000596.

Translation of Office Action Dated Dec. 28, 2012 From the State Intellectual Property Office of the People's Republic of China Re. Application No. 200980131795.7.

Translation of Office Action Dated Feb. 17, 2012 From the State Intellectual Property Office of the People's Republic of China Re. Application No. 200980131795.7.

Translation of Office Action Dated Aug. 15, 2013 From the State Intellectual Property Office of the People's Republic of China Re. Application No. 200980131795.7.

Translation of Search Report Dated Aug. 15, 2013 From the State Intellectual Property Office of the People's Republic of China Re. Application No. 200980131795.7.

Translation of Notice of Reason for Rejection Dated May 14, 2013 From the Japanese Patent Office Re. Application No. 2011-514197.

Official Decision of Rejection Dated Dec. 13, 2013 From the Japanese Patent Office Re. Application No. 2011-514197 and Its Translation Into English.

* cited by examiner

METHOD AND AN APPARATUS FOR PROCESSING A LENTICULAR PRINTING SUBSTRATE

RELATED APPLICATIONS

This Application is a National Phase of PCT Patent Application No. PCT/IL2009/000596 having International filing date of Jun. 16, 2009, which claims the benefit of U.S. Provisional Patent Application No. 61/129,270 filed on Jun. 16, 2008. The contents of the above Applications are all incorporated herein by reference.

FIELD AND BACKGROUND OF THE INVENTION

The present invention provides facile means for aligning web-fed media used in lenticular printing and lithographic processes. Specifically, the present invention allows for the ready transformation of traditional rolls or drums used in conventional or digital printing technologies into highly accurate guide rolls for lenticular printing. By bonding or attaching an appropriate lenticular or lenticular-like surface to one or a plurality of rollers, one may rapidly and inexpensively adapt printing presses or digital printers for high-precision lenticular printing.

Lenticular printing has been in use since the 1940's. Specifically, lenticular printing involves dividing visual images into strips, alternating the image strips and arranging the image strips under a field of lenticular lenses. Lenticular visual effects include apparent 3-dimensional depth, alternating images as a function of viewing angle ("flip"), and apparent "motion" of an object in response to viewer movement. Lenticular printing has found tremendous use in advertising and promotion. Large lenticular displays feature prominently at airports and shopping malls.

Lenticular printing relies on unique optical phenomena as perceived by a viewer. As such, lenticular printing has an extremely low tolerance level for misalignment of images relative to the lenticular lenses through which the images are seen. Lenticular printing relies on unique optical phenomena as perceived by a viewer. Each Lenticular print is usually based on a number of images, each sliced into strips, which are then interlaced with one or more other images. The lenses are lined up with each image interlace, so that light reflected off, or transmitted through, each strip is refracted in a slightly different direction, but the light from all strips of a given image are sent in the same direction. The end result is that a single eye or camera looking at the print sees a single whole image, but an eye or camera with a different angle of view will see a different image. As such, lenticular printing has an extremely low tolerance level for misalignment of image strips relative to the lenticular lenses through which the images are seen. Even small displacements or misalignment of image strips may lead change the aforementioned end result and the observer may see reflections of strips of a number of images simultaneously instead of seeing them in a consecutive manner. Lenticular printing generally works on high accuracy in the feeding and placement of lenticular printing substrate into printing machines. Small errors in printing can be costly and time-consuming. In order to produce high quality lenticular printing, the lenticular printing media and the printing apparatus should remain aligned, optionally completely, during all stages of the printing process, especially during ink transfer. A common misalignment problem involves shifting of the feed lenticular printing substrate during a printing run. Specifically, lenticular web media travel between pairs of rolls, an idler roll and an impression roll, several such pairs generally being used in series to produce complete high-quality images. Small lenticular printing substrate misalignments due to web wander or web tracking motions can cause significant reduction in quality of the highly sensitive lenticular image. Any motion or distortion of lenticular web media during printing can lead to costly and irreversible misalignment.

One method for guaranteeing alignment of lenticular web feed is described by Bravenec in U.S. Pat. No. 6,276,269. In his method, Bravenec describes a guide roll having "a band of circumferentially extending grooves formed on an outer surface of the roller." The grooves act to align lenticular lens material that is fed into the printing machine (printing occurring on the flat side opposite the lenticular lenses).

SUMMARY OF THE INVENTION

According to some embodiments of the present invention there is provided a method for preparing a lenticular guide roll for a production of a lenticular image. The method comprises providing a printing roll of a printing press and a first piece of lenticular media, the first piece of lenticular printing substrate having a pitch being substantially identical to a second piece of lenticular printing substrate to be used in the production and attaching the first piece of lenticular printing substrate to the printing roll. The attaching allows the maneuvering of the second piece of lenticular printing substrate in the printing press by the printing roll.

Optionally, the production comprises lenticular printing run production.

Optionally, the printing roll is selected from a group consisting of an idler roll and an impression cylinder.

Optionally, the step of attaching comprises bonding the first piece of lenticular media to the printing roll.

Optionally, the maneuvering includes using the printing roll with the attached first piece of lenticular printing substrate for registering the position of the second piece of lenticular printing substrate during the production.

Optionally, the printing roll is one of a plurality of printing rolls used for the production.

Optionally, the printing roll is at least partially covered on its circumference with the first piece of lenticular printing substrate.

Optionally, the first piece of lenticular printing substrate has grooves for aligning the second piece of lenticular printing substrate during the production.

Optionally, the method further comprises shaping first and second opposing edges of the first piece to allow the splicing thereof during the attaching.

More optionally, the method further comprises shaping the first opposing edge of according to a first wavy pattern and the second opposing edge according to a second wavy pattern, the first and second patterns being inverted to one another.

More optionally, the method further comprises the first wavy pattern is a rectangular wave pattern.

According to some embodiments of the present invention there is provided a kit for converting a standard printing roller into a lenticular guide roll of a press. The kit includes a first piece of lenticular printing substrate and an attachment element configured for fixing the first piece of lenticular printing substrate onto the standard printing roller. The fixing allows using the press for processing a second piece of lenticular printing substrate.

Optionally, the processing comprises printing on the second piece of lenticular printing substrate.

Optionally, the fixing is performed using an adhesive material.

Optionally, the printing roll is selected from a group consisting of: an idler roll and an impression cylinder.

Optionally, lenticules of the first and second pieces of a lenticular printing substrate have at least one of a substantially identical pitch and at least one substantially identical physical dimension.

Optionally, the attachment element is selected from a group consisting of a fastener, a pressing element, a staple, a clip, and a bonding element.

According to some embodiments of the present invention there is provided a method for preparing a guide roll for use in a lenticular printing run. The method comprises providing a roller and a piece of lenticular-like media, the piece of lenticular-like media having lenticule-aligning features substantially identical to a lenticular printing substrate to be used in the lenticular printing run and attaching the piece of lenticular-like media to the printing roll, such that the lenticule-aligning features associated with the lenticular-like media face away from the printing roll.

Optionally, the printing roll is an idler roll.

Optionally, the step of attaching is accomplished by application of an adhesive between the printing roll and the piece of lenticular media.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
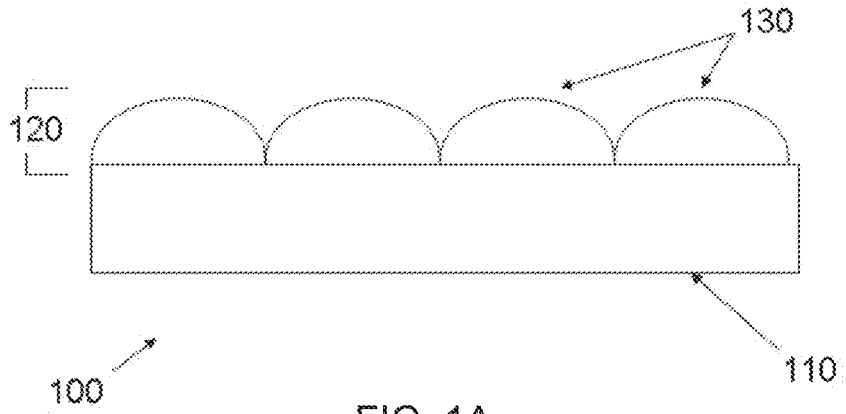
FIGS. 1A and 1B depict schematic top and side views of a lenticular printing substrate, according to some embodiments of the present invention.

Among the several objects of the present invention is provision of a guide roll used in lenticular and similar printing processes. A lenticular guide roll may be formed by attachment of a piece of lenticular printing substrate to a printer roll, the lenticular web structure facing outwards and serving to align lenticular web media fed into a printing press and over the guide roll. Attachment of lenticular web structure to the roll may be accomplished by any means including but not limited to gluing and clipping. Attachment may be permanent or transient. It will be understood that attachment of lenticular printing substrate to a printing roller is effected by bonding or attaching the non-lenticular ("flat") side of the lenticular printing substrate to the full circumference of the roller, so that the lenticular lens side of the attached lenticular printing substrate will be facing outwards and towards feed lenticular web material run through the printing press. The lenticular printing substrate selected for attachment to the roller is substantially identical in pitch to lenticular printing substrate later used in lenticular printing.

Non-lenticular printing substrate may be used in a similar manner wherein lenticular-aligning features of such materials are facing outwards from an ordinary printing roller onto which a non-lenticular printing substrate has been attached. Lenticular-aligning features have dimensions and pitch that allow for interlocking with lenticular lenses associated with a printable lenticular printing substrate and thus may maintain alignment of lenticular printing substrate during printing of images on the lenticular media.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

In the following description, numerous specific details are set forth in order to provide a thorough understanding of the present invention. It will be apparent, however, to one skilled in the art that the present invention may be practiced without these specific details. In other instances alternative materials may be employed in the present invention without departing from the scope and spirit of the instant invention. A unique aspect of the invention, independent of material or specific attachment strategies, is attachment of a lenticular printing substrate to a standard printer roll, the lenticular lenses facing outwards and acting as a guide for lenticular web media fed into a printing machine in which the guide roll is employed.

To better understand the invention described in the present invention, certain terms are defined.

"Lenticular", "lenticular printing", "lenticular lens", "lenticular effect", and "lenticule" may have their normal meaning in the physical arts.

"Lenticular guide roll" may refer to a roller, standard or otherwise, onto which a lenticular printing substrate has been attached, with the associated lenticular lenses facing outward away from the printer roll.

"Media", "web media", "input media", "feed lenticular media" generally refer to lenticular stock media that may be fed into a printing press for deposition of image(s) on substantially one side of the lenticular stock media. "Lenticular printing substrate" generally refers to lenticular printing substrate that generally may be attached to a printer roll or drum.

"Printing run" refers to a process in which a solid or liquid medium is transferred to a receiving medium for the purpose of creating text, drawings, figures, content, or the like. Nonlimiting examples of a printing run include deposition of colored inks onto lenticular medium or black ink onto newsprint.

"Printing press" as applied in the present invention generally refers to mechanical or digital printing machines that are amenable for use in production of lenticular images. As used herein a printing press means, inter alia, a sheet-fed press, which is designed to print on individual sheets of lenticular media, and a web press, which is designed to print on continuous rolls of lenticular media. The term may be used for describing other devices for use in production of lenticular images, such as a lamination machine for attaching a lenticular material to a printed image.

"Roll", "printing roll", "roller" and "drum" are used interchangeably and may have their normal meaning as applied to the printing arts. "Circumference" with respect to a printing roll refers to the face of a printing roll that may contact printable media. "Guide roll" or "guide drum" may refer to idler roll or impression roll over which lenticular printing substrate is drawn during printing. A lithographic machine is a form of printing press. Additionally or alternatively, "rollers" may refer to any cylindrical element employed in a production process, such as rollers used to place labels on food containers.

A "lenticular guide roll" refers to any printing roll or drum onto which lenticular printing substrate has been attached as described in the instant invention.

"Lenticular-like material" is a material that is not appropriate for lenticular printing but has features of dimension and pitch that can interact with lenticular lenses of a lenticular printing substrate to align the lenticular printing substrate in a printing press. "Lenticule-aligning features" refer to features on lenticular-like material that can serve to align lenticular feed media in a printing press. Lenticule-aligning features generally have dimensions, shape, and pitch that allow for their interaction with a printable lenticular medium.

"Flip" may have its normal meaning as applied to lenticular images. Flip generally refers to an optical phenomenon in which different images associated with a lenticular optical element may be viewed by a viewer as a function of his/her viewing angle and distance with respect to a lenticular display.

"Glue" refers to any adhesive material in any state of aggregation, for example an adhesive liquid, an adhesive solid, such as powder, an adhesive gel or otherwise that is employed in attaching lenticular printing substrate onto a printing press roll. Glues may be used in transient or permanent attachment strategies.

"Attachment" with respect to a lenticular printing substrate or a lenticular-like material to a roller may be achieved by any means, including but not limited to gluing, fastening, pressing, stapling, and bonding. Electrical or magnetic means may be used in attachment of lenticular printing substrate or lenticular-like material to a roller.

The invention described herewith has a particular application to the printing of lenticular images. Lenticular images allow for increased three-dimensional appearance, switching of images according to viewing angle, and apparent motion of an object. Lenticular images are formed when two images are cut into strips and printed in an alternating fashion on the smooth side of a lenticular printing substrate. On the opposite side of the lenticular printing substrate are lenticular lenses that allow for selective viewing of one image but not the other. Moving to the left or right, a viewer can switch viewable images. This multi-image system is very popular in advertising and promotional activities.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

For purposes of better understanding some embodiments of the present invention, as illustrated in FIGS. 1-5 of the drawings, reference is first made to the construction of lenticular printing substrate as illustrated in FIG. 1.

Figure 1B:
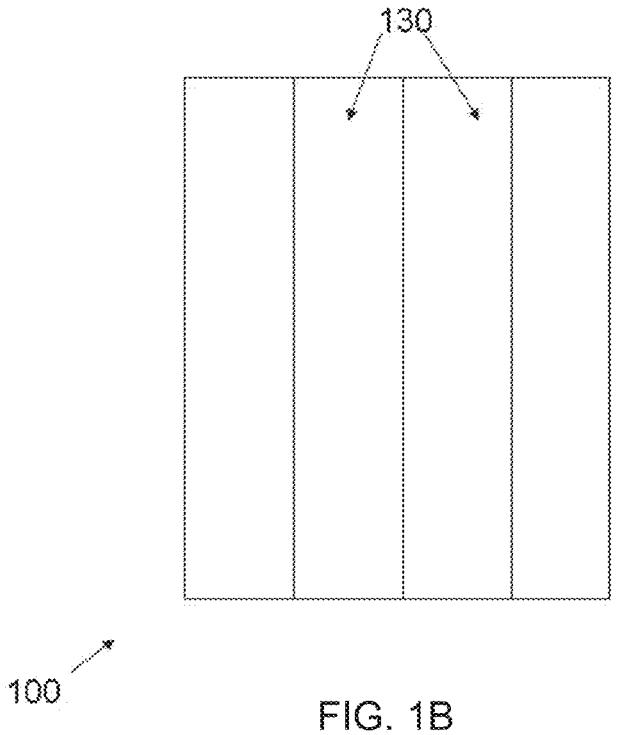

FIG. 1A depicts a schematic view of a cross-section of a lenticular printing substrate (100). Specifically, the lenticular printing substrate (100) has two components, a flat side (110) and a lenticulated side (120). It is noted that the lenticular printing substrate (100) is generally transparent so as to allow for image viewing through the lenticular printing substrate; images are printed with the images facing the lenticular lenses. As such, images deposited through printing on the flat side (110) may be viewed through the lenticular lenses (130) that populate the lenticulated side (120) of the lenticular printing substrate (100). FIG. 1B depicts a schematic top-view of the lenticular printing substrate (100) in which the flat side is not visible. Instead, one may see rows of lenticular lenses (130) that populate the lenticulated side of the lenticular printing substrate.

Figure 2:
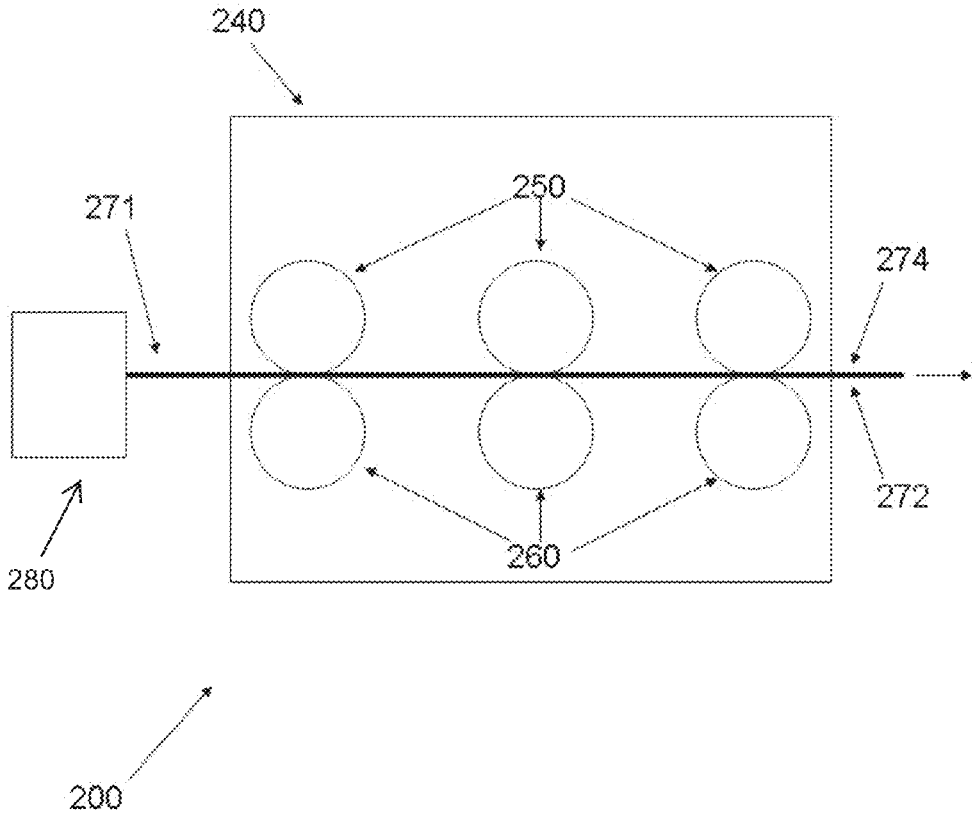
FIG. 2 depicts a schematic view of a standard digital printing press as employed in deposition of multiple images on printable lenticular media, according to some embodiments of the present invention.

FIG. 2 depicts a schematic view of a standard lenticular printing process (200). A printing press (240) houses rolls (250, 260) that move, guide and print lenticular web media (271). Feed lenticular web media (271) is entered into the printing press (240) from a stock source (280). The lenticular web media (271) has lenticular side (272) facing down, with flat printing side (274) facing up. Impression rolls (250) and idle rolls (260) interact with lenticular web media (271) during the printing of images (not shown) onto the flat printing side (274) of the lenticular web media (271).

Figure 3A:
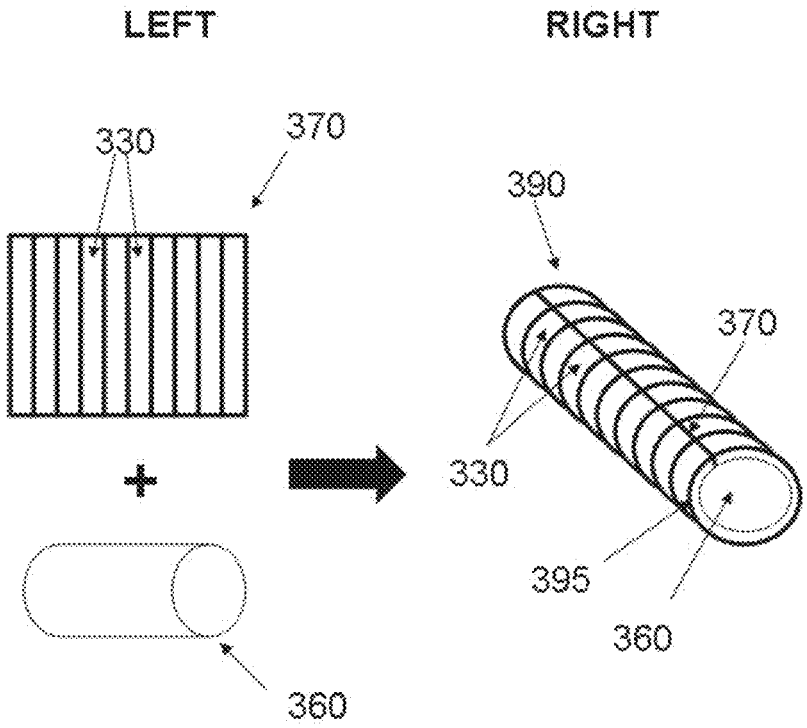
FIG. 3A depicts the components required in converting a standard printing roller into a lenticular guide roll, according to some embodiments of the present invention.

Reference is now made to FIG. 3A which depicts the components of a lenticular guide roll. On the Left side of FIG. 3A are shown a standard printing roller (360) and a lenticular printing substrate (370, as shown from above) as supplied. The lenticular printing substrate (370) is attached to the standard printing roller (360) with lenticular lenses (330) of the lenticular printing substrate (370) facing outwards. The resulting structure (Right side of FIG. 3A) is a lenticular guide roll (390). As shown on the Right side of FIG. 3A, the lenticular lenses (330) run the entire circumference of the lenticular guide roll (390). The lenticular printing substrate (370) is attached to the standard printing roller (360) so that the edges of lenticular printing substrate (370) form a tight seam (395) with the edge of the printing roll (360). It is noted that the arrays of the lenticular lenses (330) associated with lenticular printing substrate (370) may be parallel or perpendicular to the central axis of the printing roll (360). One advantage of the instant invention is that by using a lenticular printing substrate (370) from the lenticular printing substrate to be printed or other appropriate source, one may ensure that the pitch of the grooves in the lenticular guide roll (390) perfectly matches the pitch of the lenticular printing substrate to be printed (not shown). In addition, there is no need to manufacture a special cylinder/roll. An original cylinder of any given digital printing machine may be appropriately and easily modified. For example, the lenticular printing substrate (370) can be mounted on the cylinder that is already a part of the machine. The tight seam (395) may be formed by applying glue or other appropriate agent between the edges of the lenticular printing substrate (370) and the standard printing roller (360). Alternatively, glue may be placed fully between the lenticular printing substrate (370) and the standard printing roller (360).

Figure 3B:
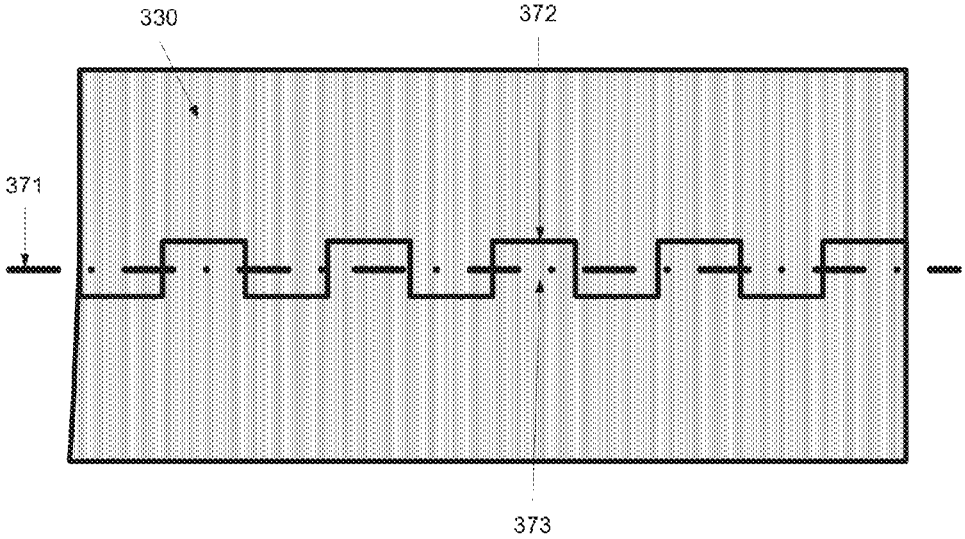
FIG. 3B is a schematic illustration of the splicing of the edges of a lenticular printing substrate, according to some embodiments of the present invention.

Reference is now also made to FIG. 3B, which is a schematic illustration of spliced edges of a lenticular printing substrate that is rolled around a conveyor or impression roller (360), according to some embodiments of the present invention. As depicted in FIG. 3A, the lenticular printing substrate (370) encircles the rounded face of standard printing roller (360). In order to assure that the arrays of the lenticular lenses (330) of the lenticular printing substrate (370) are aligned in parallel to a common axis, such as the perpendicular to the cylindrical axis (371) of standard printing roller (360), two opposite edges of the lenticular printing substrate (370) are spliced. Optionally, one of the edges is shaped to a wavy pattern (372), such a rectangular pattern, for example a square pattern, and the other is shaped with a pattern that is inverted thereto (373). In such an embodiment, the splicing of the edges aligns the arrays of the lenticular lenses (330) of the lenticular printing substrate (370) in parallel to a common axis, as shown at FIG. 3B. The splicing of edges with such a wavy pattern assures that even if the wavy segments of the lenticular printing substrate (370) do not intertwined to form linear lenticular lenses arrays (330), the lenticular lenses arrays (330) of the lenticular printing substrate (370) are aligned to support conveying of the lenticular printing substrate (100) in parallel to the perpendicular of the cylindrical axis (371) during the printing process. Optionally, the aforementioned wave pattern is formed using a punching machine with a blade having a respective wavy pattern.

The facile construction of a lenticular guide roll as shown schematically in FIG. 3A is a major advantage over specialized rollers with grooves, as the latter is generally prepared uniquely for each type of lenticular printing substrate employed in printing. In commonly used embodiments, either one would have to replace standard rolls with specialized grooved rolls or simply rely on standard rolls to prevent misalignment of lenticular printing substrate during printing. Either option is expensive, the first due to the special rolls and manpower required to install them; the latter due to the high error rate and lost printing time and resources. In the present invention, a portion of the lenticular printing substrate used for printing or other media with appropriate pitch is first attached to a printing roll, generally the idler roll or impression cylinder. After attachment, feeding of printable lenticular printing substrate over the lenticular guide roll (390) leads to rapid alignment due to the interactions between lenticules associated with guide roll and print media (see FIG. 4B and description below).

Figure 4A:
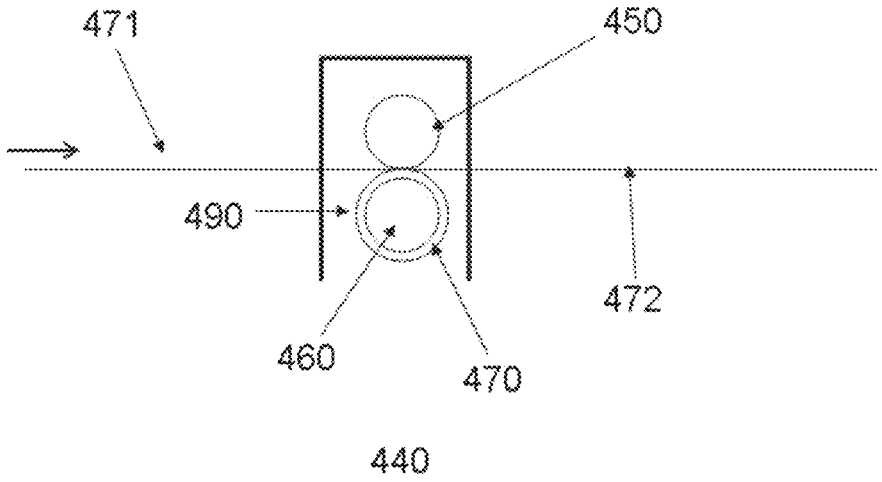
FIG. 4A depicts a lenticular guide roll in use in feeding lenticular web media into and through a printing step, according to some embodiments of the present invention.

FIG. 4A depicts application of a lenticular guide roll (490) in a printing press (440). Lenticular web media (471) has lenticular side (472) facing downwards as it is run between printing rolls (450, 490). The lenticular side (472) interacts directly with the lenticular guide roll (490). The lenticular roll (490) is composed of a standard printing roller (460) and a lenticular printing substrate (470), with lenticules facing away from the printing roll (460). In this figure, the top roll is the impression roll (450), while the bottom roll is the lenticular guide roll (490) built on an idler roll (460).

Figure 4B:
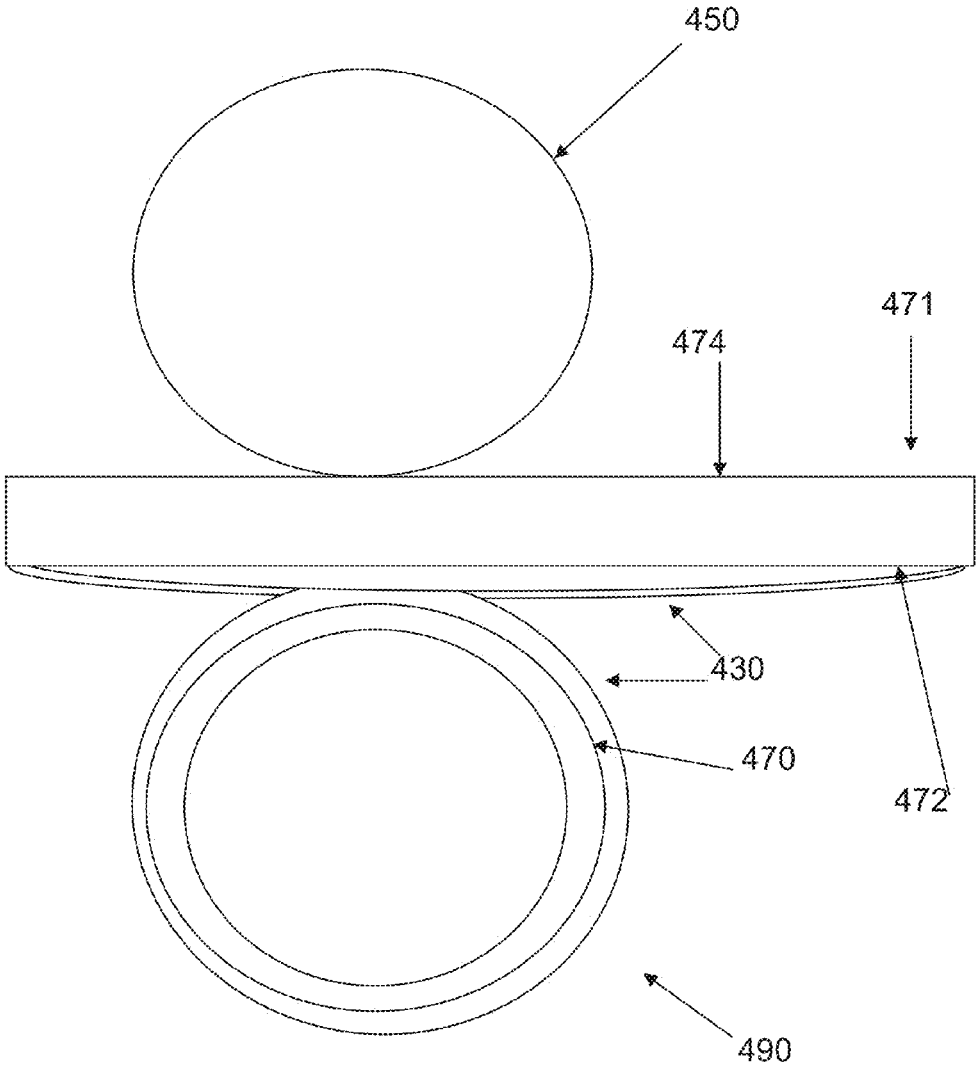
FIG. 4B depicts a schematic close up of intercalation of lenticular lenses on guide roll and printable media, according to some embodiments of the present invention.

FIG. 4B schematically depicts close-up detail of the interaction of lenticular elements, namely the lenticular side (472) of lenticular web media (471) on which printing is performed, and the lenticular printing substrate (470) associated with a lenticular guide roll (490). As is shown in the figure, proper pitch of the lenticular printing substrate (470) generally achieved by taking a piece of the lenticular web media (471) being subjected to printing—allows for perfect lock-in-step of lenticular lenses (430) associated with both lenticular web media (470) and lenticular guide roll (490). The advantage of this arrangement includes but is not limited to significant reduction in cost for preparing a high-quality guide roll. Additionally, there is a higher level of alignment success when the lenticular lenses associated with guide roll and printed media mesh with one another. Printing occurs on the flat printing side (474) during its passage under the impression roll (450).

Figure 5:
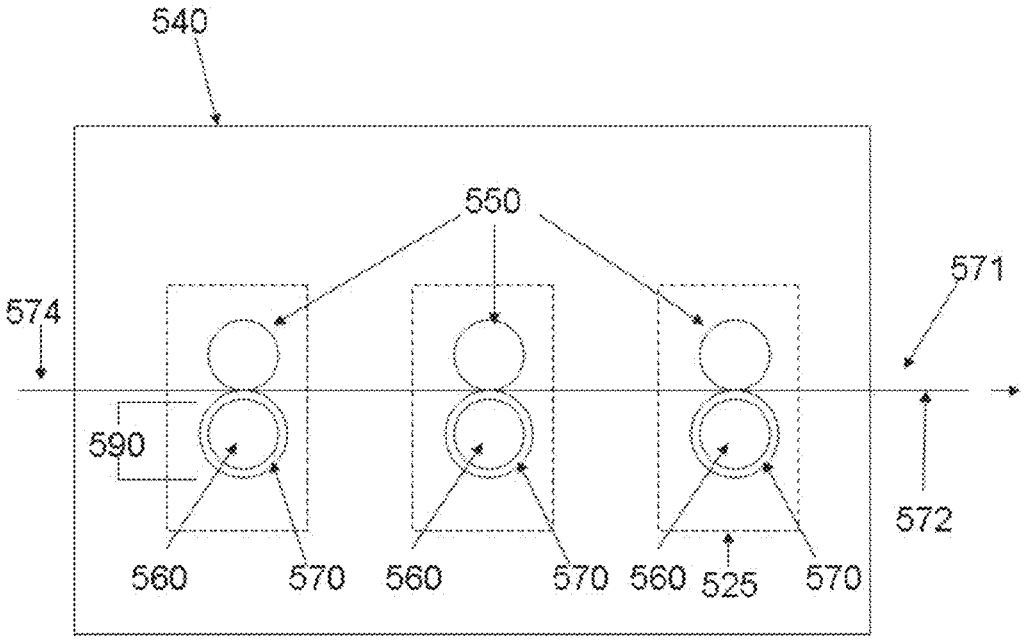
FIG. 5 depicts a plurality of lenticular guide rolls as employed in some embodiments of the present invention.

FIG. 5 depicts multiple roll assemblies (525) as they appear in a single printing press (540). Each roll assembly has two rolls, one an impression roll (550) and the second a lenticulated guide roll (590) that is of itself composed of an idler roll (560) and a piece of lenticulated material (570). Each impression roll (550) delivers a different component or color of the mixed images to the passing lenticular web media (571). Printing occurs on the flat printing side (574) of the lenticular web media (571), while alignment is effected by gearwheel style interaction between the printable lenticular web media (571) and the lenticular printing substrate (570) associated with the lenticular guide roll (590).

Figure 6:
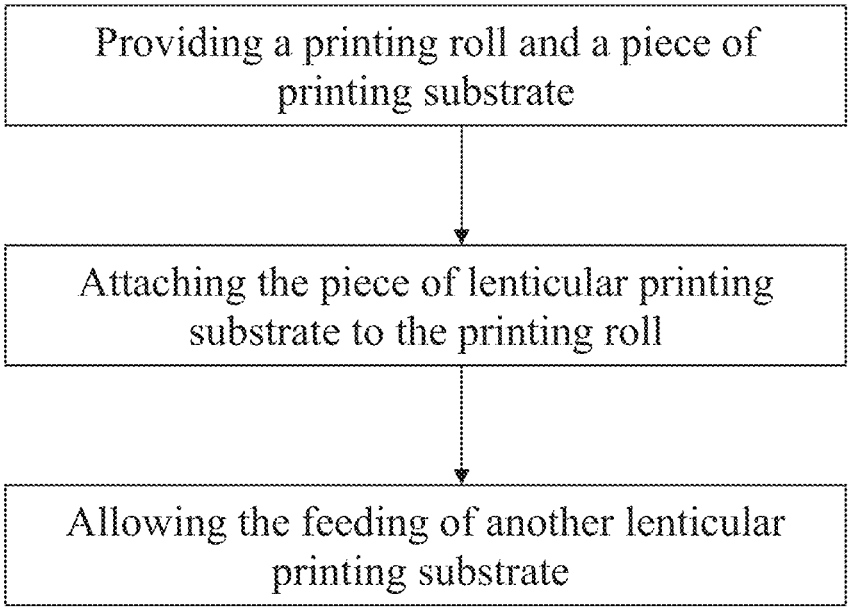
FIG. 6 depicts a flow-chart defining a method for producing a lenticular roll guide, according to some embodiments of the present invention.

FIG. 6 depicts a flowchart for a method of producing a lenticular guide roll (600). Specifically, a standard printing roller (601), such as an impression roll and/or an idler roll, and a piece of lenticular media, which is substantially identical in pitch to the lenticular printing substrate that will be run through the lenticular roll guide, are provided. There is an advantage for similarity between the first piece of lenticular printing substrate that is attached to a standard printing roller and lenticular printing substrate on which printing is to be performed. The advantage is realized as substantially identical features such as pitch, physical orientation of lenticular lenses, and dimensions of said lenticular lenses allow for facile alignment of printable lenticular printing substrate along the lenticular roll guide. The next step in the method is physically associating (603) the provided piece of lenticular printing substrate with the standard printing roller. Association may be formed by gluing, clipping, and/or by any operation that allows association, optionally transient, of the provided piece of lenticular printing substrate with the standard printing roller. Finally, in an additional step (605), printable lenticular printing substrate is fed into a printing press or other machine in which the lenticular guide roll with the provided piece of lenticular printing substrate may align pieces of lenticular printing substrate which optionally have one or more similar characteristics.

In one exemplary embodiment of the present invention, HP Indigo press ws4500 with 3-D Lenticular Application was procured, see http://h10010.www1.hp.com/wwpc/us/en/ga/WF05a/18972-18972-236257-90275-90271-3252083.html, which incorporated herein by reference. A portion of lenticular web media used for printing is cut from stock lenticular web media. This portion is glued and/or firmly attached at its edges to an idler roller of the ws4500. The lenticular printing substrate glued and/or firmly attached to the roller edges completely or partially covers the roller's surface and has lenticular lenses facing away from the roller. Similarly, substantially identical pieces of lenticular printing substrate are glued and/or firmly attached to all idler rollers associated with the ws4500. To begin a lenticular printing session, suitable images are selected for printing, such as 3D, "flip" or any other image which can be advantageously viewed through a lenticular lens. Lenticular media, substantially identical to that glued and/or firmly attached to at least one roller, is fed through the ws4500 printer. Lenticules from the lenticular guide roller interact with lenticules from the printable lenticular printing substrate to form an interlocking mesh of lenticules. This interlocking mesh allows for alignment of lenticular printing substrate in the printing press, while single or multi-color printing occurs on the flat printable side of the feed lenticular media. Printing continues on the flat printable side of the lenticular printing substrate while lenticules from the guide roll and from the lenticular printing substrate interact to guarantee proper alignment of images. When the printing run is complete, the lenticular printing substrate may or may not be removed from the idler rollers. The ws4500 may be used in its HP-provided condition or a different lenticular printing substrate may be attached to the HP-supplied one or more rollers for another lenticular printing run as described above. It should be noted that any sheet fed press and/or web press may be similarly adjusted for printing on lenticular media.

The present invention has been described with a certain degree of particularity, however those versed in the art will readily appreciate that various modifications and alterations may be carried out without departing from the spirit and scope of the following claims. Therefore, the embodiments and examples described here are in no means intended to limit the scope or spirit of the methodology and associated devices related to the present invention. The guide material glued and/or firmly attached to a standard printing roller does not necessarily have to be lenticular, if it can act to align the lenticular web material or similar media that is the subject of printing. The advantages of the present invention include the ability to use standard printing equipment for the highly-stringent requirements of lenticular printing. The invention can lead to savings in money and time as well as yield a higher percentage of finished lenticular images that are usable for advertising, promotion, or other and varied applications.

Throughout this application, various embodiments of this invention have been presented in a range format. It should be understood that the description in range format is merely for convenience and brevity and should not be construed as an inflexible limitation on the scope of the invention.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method for preparing a lenticular guide roll for a production of a lenticular image, comprising:

providing a printing roll of a printing press and a first piece of lenticular printing substrate in the form of a flat flexible sheet of lenticular web media having opposite edges, said first piece of lenticular printing substrate having grooves at a pitch being substantially identical to a pitch of a plurality of grooves of a second piece of lenticular printing substrate of lenticular web media to be used in the production of the lenticular printing substrate;

rolling said first piece of lenticular printing substrate around said printing roll such that said grooves face away from said printing roll and said opposite edges form a seam with the grooves in alignment on top of said printing roll; and attaching said first piece of rolled lenticular printing substrate to said printing roll;

wherein said pitch of said grooves aligns the maneuvering of said second piece of lenticular printing substrate in said printing press by said printing roll;

wherein said first and second pieces of lenticular printing substrate are taken from the same lenticular web media.

2. The method according to claim 1, wherein the production comprises lenticular printing run production.

3. The method according to claim 1, wherein said printing roll is selected from a group consisting of an idler roll and an impression cylinder.

4. The method according to claim 1, wherein said step of attaching comprises bonding said first piece of lenticular substrate to said printing roll.

5. The method according to claim 1, wherein said maneuvering includes using said printing roll with said attached first piece of lenticular printing substrate for registering a position of said second piece of lenticular printing substrate during the production.

6. The method according to claim 1, wherein said printing roll is one of a plurality of printing rolls used for the production.

7. The method according to claim 1, wherein said printing roll is at least partially covered on its circumference with said first piece of lenticular printing substrate.

8. The method according to claim 1, further comprising shaping first and second opposing edges of said first piece to allow the splicing thereof during said attaching.

9. The method according to claim 8, further comprising shaping said first opposing edge of according to a first wavy pattern and said second opposing edge according to a second wavy pattern, said first and second patterns being inverted to one another.

10. The method according to claim 9, wherein said first wavy pattern is a rectangular wave pattern.

11. A kit for preparing a standard printing roller into a lenticular guide roll of a printing press for printing on a lenticular printing substrate, said kit comprising:

a first piece of a lenticular printing substrate in the form of a flat flexible sheet of lenticular web media having opposite edges and set to be rolled around said printing roll so that said opposite edges form a seam; and an attachment element configured for fixing said first piece of lenticular printing substrate onto the standard printing roller by rolling said first piece of said lenticular printing substrate around said printing roll;

wherein said fixed first piece of lenticular printing substrate aligns a second piece of lenticular printing substrate during a processing thereof by the printing press;

wherein said first and second pieces of lenticular printing substrate are taken from the same lenticular web media.

12. The kit according to claim 11, wherein said processing comprises printing on said second piece of lenticular printing substrate.

13. The kit according to claim 11, wherein said fixing is performed using an adhesive material.

14. The kit according to claim 11, wherein said printing roll is selected from a group consisting of: an idler roll and an impression cylinder.

15. The kit according to claim 11, wherein lenticules of said first and second pieces of a lenticular printing substrate have at least one of a substantially identical pitch and at least one substantially identical physical dimension.

16. The kit according to claim 11, wherein said attachment element is selected from a group consisting of a fastener, a pressing element, a staple, a clip, and a bonding element.

17. The method according to claim 1, wherein said first and second pieces of lenticular printing substrate are generally transparent.

* * * * *